US010711229B2

(12) United States Patent
Neto et al.

(10) Patent No.: US 10,711,229 B2
(45) Date of Patent: Jul. 14, 2020

(54) DETERGENT COMPOSITION IN EFFERVESCENT TABLET FORM

(71) Applicant: WASH TO GO, Unipessoal Lda., Freguesia de Cantanhede e Pocarica (PT)

(72) Inventors: Sergio de Magalhães Neto, São Paulo (BR); Gabriella de Oliveira Santos Ribeiro, São Bernardo do Campo (BR)

(73) Assignee: WASH TO GO. Unipessoal Lda., Freguesia de Cantanhede e Pocarica (PT)

( * ) Notice: Subject to any disclaimer, the term of this patent is extended or adjusted under 35 U.S.C. 154(b) by 0 days.

(21) Appl. No.: 16/009,493

(22) Filed: Jun. 15, 2018

(65) Prior Publication Data

US 2018/0362901 A1 Dec. 20, 2018

Related U.S. Application Data

(60) Provisional application No. 62/519,925, filed on Jun. 15, 2017.

(51) Int. Cl.

| | |
|---|---|
| ***C11D 17/00*** | (2006.01) |
| ***C11D 3/10*** | (2006.01) |
| ***C11D 11/00*** | (2006.01) |
| ***C11D 1/14*** | (2006.01) |
| ***C11D 3/20*** | (2006.01) |
| ***C11D 3/42*** | (2006.01) |
| ***C11D 3/12*** | (2006.01) |
| ***C11D 3/37*** | (2006.01) |
| ***C11D 3/08*** | (2006.01) |
| ***C11D 3/48*** | (2006.01) |
| ***C11D 3/00*** | (2006.01) |
| ***C11D 3/50*** | (2006.01) |
| ***C11D 3/386*** | (2006.01) |
| ***C11D 10/04*** | (2006.01) |
| *C11D 1/62* | (2006.01) |
| *C11D 1/29* | (2006.01) |

(52) U.S. Cl.

CPC ..... *C11D 17/0047* (2013.01); *C11D 1/146* (2013.01); *C11D 3/0052* (2013.01); *C11D 3/08* (2013.01); *C11D 3/10* (2013.01); *C11D 3/124* (2013.01); *C11D 3/2079* (2013.01); *C11D 3/2086* (2013.01); *C11D 3/3703* (2013.01); *C11D 3/3776* (2013.01); *C11D 3/386* (2013.01); *C11D 3/42* (2013.01); *C11D 3/48* (2013.01); *C11D 3/50* (2013.01); *C11D 10/04* (2013.01); *C11D 11/00* (2013.01); *C11D 17/0073* (2013.01); *C11D 1/29* (2013.01); *C11D 1/62* (2013.01)

(58) Field of Classification Search

CPC ..... C11D 17/0047; C11D 17/0073

See application file for complete search history.

*Primary Examiner* — Khanh T Nguyen

(74) *Attorney, Agent, or Firm* — Scarinci Hollenbeck, LLC

(57) ABSTRACT

An effervescent detergent tablet comprising calcium carbonate, sodium laureth sulfate, citric acid, tartaric acid, sodium bicarbonate, fragrance, Stepantex VT 90 (Methyl bis[ethyl (tallowate)]-2-hydroxyethyl ammonium methyl sulfate), polyhexamethylene biguanide (PHMB), stearic acid, silicon dioxide, enzymes mix, Long Brite (Disodium Distyrylbiphenyl Disulfonate) Magnesium Stearate, Kollidon CL, Chlorhexidine Hydrochloride and calcium carbonate and sodium disilicate mix.

3 Claims, 2 Drawing Sheets

DETERGENT COMPOSITION IN EFFERVESCENT TABLET FORM

FIELD OF THE INVENTION

This disclosure relates generally an effervescent tableted portable detergent comprising of detergent, softener, microbial and enzymatic technology containing active oxygen which make rising of clothing after washing unnecessary.

BACKGROUND

Detergent tablets are known in the art and can provide significant advantages to the consumer compared with conventional powder detergents. However, it is highly desirable to provide an effervescent detergent tablet that is a complete washing solution, portable, and robust formulated with detergent, softener, microbial and enzymatic technology containing active oxygen thereby making the removal of stains easy while not requiring any rinsing. Detergent tablets are usually focused at the home market, designed to be used primarily in washing machines along with many different products. The present invention comprises all the characteristics of a complete washing solution for clothes without the need of a washing machine or rinsing.

BRIEF SUMMARY

The above-recited needs being addressed with an exemplary embodiment of a detergent tablet that includes a microbial and enzymatic technology that works together to optimize the efficiency of the detergent agents in low water temperatures and short laundry cycles while keeping the garments free of microbes through the use of biguanides. The disclosed embodiment further provides for the release of oxygen through the use of effervescent components which provides for the deep cleaning of stains using the controlled release of effervescence from the tablet. The disclosed embodiment may also include antibacterial and antifungal action as well as whitening and softening components.

In an exemplary embodiment, each detergent tablet is used in conjunction with 1000 ml of water and the clothing is immersed in the solution for 15 (fifteen) minutes.

The exemplary embodiment of a detergent tablet comprising calcium carbonate, sodium laureth sulfate, citric acid, tartaric acid, sodium bicarbonate, fragrance, Stepantex VT 90 (Methyl bis[ethyl (tallowate)]-2-hydroxyethyl ammonium methyl sulfate), polyhexamethylene biguanide, stearic acid, enzyme mix, silicon dioxide, Long Brite (Disodium Distyrylbiphenyl Disulfonate), Magnesium Stearate, Kollidon CL (Polyvinylpyrrolidone, crosslinked), Chlorhexidine Chloride and Sodium di silicate.

The present invention comes in 6 (six) different versions: ORIGINAL (regular formula), BABY (designed for baby clothes), DELICATE (designed for underwear), SPORT (designed for sportswear), ARMY (design for extra cleaning), TENNIS (designed for footwear). The main difference of each version is the quantities of each component in the formula.

BRIEF DESCRIPTION OF THE DRAWINGS

This disclosure is further described in the detailed description that follows, with reference to the drawings, in which.

DETAILED DESCRIPTION

Figure 1:
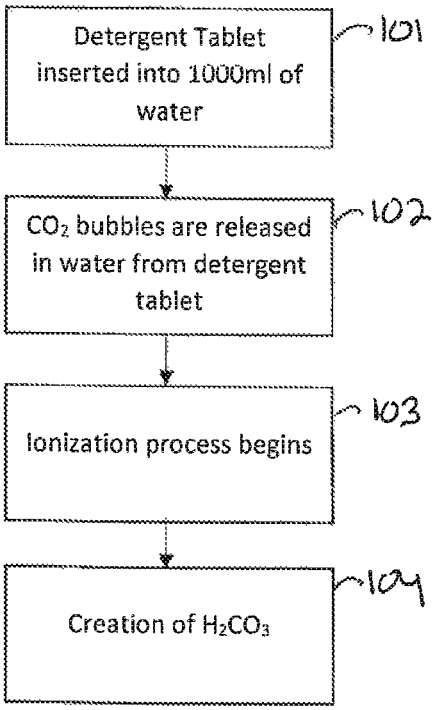
FIG. 1 is a flow chart depicting the cleaning process according to an exemplary embodiment.

An exemplary embodiment of a detergent tablet is disclosed. A detailed embodiment of the disclosed detergent tablet is disclosed herein, however it is to be understood that the disclosed embodiment is merely exemplary of the invention that may be embodied in various and alternative forms.

An exemplary embodiment of the detergent tablet is comprised of (a) an enzymatic cleaning technology, (b) an effervescent cleaning technology, (c) a bleaching and softening technology, and (d) an antimicrobial technology.

The specific components of the exemplary embodiment are calcium carbonate, sodium laureth sulfate, citric acid, tartaric acid, sodium bicarbonate, fragrance, Stepantex VT 90 (Methyl bis[ethyl (tallowate)]-2-hydroxyethyl ammonium methyl sulfate), polyhexamethylene biguanide (PHMB), stearic acid, silicon dioxide, enzymes mix, Long Brite (Disodium Distyrylbiphenyl Disulfonate) Magnesium Stearate, Kollidon CL, Chlorhexidine Hydrochloride and calcium carbonate and sodium disilicate mix.

Calcium carbonate is used to hold all the component ingredients of the detergent tablet together.

Sodium laureth sulfate is a tensoactive. It is a powerful surfactant/detergent which allows for the actual cleaning of a garment. It also is an effective degreaser.

The combination of citric acid, tartaric acid, and sodium bicarbonate work as a carrier of other active cleaning ingredients. Organic acids and a carbonated base are the necessary components of an effervescent soap formula. Citric acid and tartaric acid are provided as the organic acid component and sodium bicarbonate is provided as the carbonated base. When the detergent table comes into contact with water, the water breaks the acid molecules thereby creating ions. This ionization process generates carbonic acid (H2CO3) which is unstable and disperses very rapidly. The result is the creation of $CO_2$ bubbles which expel the cleaning particles and dirt from the fabric of the garment that is being washed. This process allows for a washing process without the need to rinse.

Fragrance is designed to give washed garments a fresh scent.

Stepantex VT 90 is a cationic tensoactive responsible for softening the washed garments.

PHMB (polyhexamethylene biguanide) is a synthetic chemical that is part of the biguanides family and is used as an antibacterial agent.

Stearic acid is a lubricant designed to reduce waste in the manufacturing process which assists in ensuring that the detergent tablets do not adhere to a compression machine used in the manufacturing process.

Silicon dioxide is an anti-humectant that protects against the detergent tablet absorbing humidity from the air.

Magnesium Stearate is a lubricant to reduce waste in the manufacturing process ensuring that the detergent tables do not adhere to a compression machine used in the manufacturing process.

Kollidon CL (polyvinylpyrrolidone, crosslinked) is a super-disintegrant and dissolution enhancer that ensure that active ingredients are released from any solid dosage form at exceptionally high speed.

The enzyme mix is used to optimize the efficiency of the detergent agents. It allows the cleaning process to occur at low temperatures and in a short period of time. When used in detergents, enzymes facilitate the removal of stains. The enzyme mix concentration is less than 1% of the total volume and, as bio catalyzers, they are not consumed during the washing process.

Long brite (disodium distyrylbiphenyl disulfonate) is an optical bleaching agent that neutralizes yellow satins and intensifies color brightness in garments.

Chlorhexidine Hydrochloride is a disinfectant and antiseptic.

Sodium disilicate is a white powder that is readily soluble in water.

In FIG. 1, a flow chart depicting the cleaning process according to an exemplary embodiment is shown. As shown in FIG. 1, the washing process begins in step 101 with the insertion of a detergent tablet into 1000 ml of water.

Once the detergent tablet has been inserted into water, $CO_2$ bubbles are released from the detergent tablet in step 102.

Once $CO_2$ bubbles have been released, an ionization process begins in step 103 in which broken $CO_2$ particles release ions into the water.

Once the ionization process has occurred, the combination of released ions and water in step 104 creates an effervescent effect as a result of the creation of carbonic acid ($H_2CO_3$).

Figure 2:
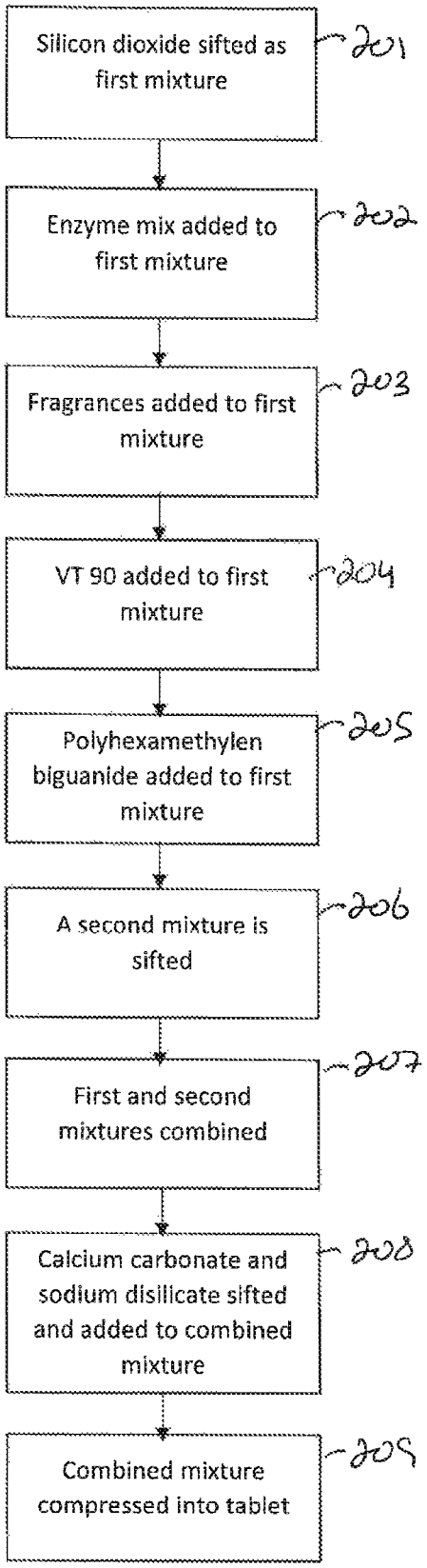
FIG. 2 is a flow chart depicting the manufacturing process according to an exemplary embodiment.

In FIG. 2, a flow chart depicting the manufacturing process according to an exemplary embodiment is shown. As shown in FIG. 2, the manufacturing process begins in step 201 with the sifting of silicon dioxide through a 1 mm sieve.

Once the silicon dioxide has been sifted, an enzyme mix is added to the sifted silicone dioxide in step 202.

Once the enzyme mix has been added, fragrances are added to the silicon dioxide and enzyme mix combination in step 203.

Once fragrances have been added, Stepantex VT 90 is added to the silicon dioxide, enzyme mix, and fragrances combination in step 204.

Once Stepantex VT 90 has been added, polyhexamethylene biguanide is added to the silicon dioxide, enzyme mix, fragrances and Stepantex VT 90 combination in Step 205.

Next, in step 206, calcium carbonate, Sodium Bicarbonate, Kollidol CL, citric acid, tartaric acid, sodium laureth sulfate, Stearic Acid, Chlorhexidine Hydrochloride, and Long Brite are sifted through a 1 mm sieve.

Once sifted, the calcium carbonate, Sodium Bicarbonate, Kollidol CL, citric acid, tartaric acid, sodium laureth sulfate, Stearic Acid, Chlorhexidine Hydrochloride, and Long Brite mix is added to the original Stepantex VT90, polyhexamethylene biguanide, silicon dioxide, enzyme mix, and fragrances combination in step 207.

Next in, step 208, the calcium carbonate and sodium disilicate mix is sifted and added to the calcium carbonate, Sodium Bicarbonate, Kollidol CL, citric acid, tartaric acid, sodium laureth sulfate, Stearic Acid, Chlorhexidine Hydrochloride, Long Brite Stepantex VT90, polyhexamethylene biguanide, silicon dioxide, enzyme mix, and fragrances mix.

Next, in step 209, Magnesium Stearate is sifted through a 0.5 mm sieve.

Once sifted, the Magnesium Stearate is added to the calcium carbonate and sodium disilicate mix, calcium carbonate, Sodium Bicarbonate, Kollidol CL, citric acid, tartaric acid, sodium laureth sulfate, Stearic Acid, Chlorhexidine Hydrochloride, Long Brite Stepantex VT90, polyhexamethylene biguanide, silicon dioxide, enzyme mix, and fragrances mix combination in step 210 and the resulting combination is compressed into a tablet form. In an exemplary embodiment, each of the mixture steps are mixed for a period of at least ten minutes.

In an exemplary embodiment, Table 1 below depicts the components of the ORIGINAL formula.

| Item | Description | Percentage in each tablet |
|---|---|---|
| 1 | calcium carbonate | 1%-2% |
| 2 | sodium laureth sulfate | 10%-15% |
| 3 | citric acid | 10%-15% |
| 4 | tartaric acid | 15%-25% |
| 5 | sodium bicarbonate | 30%-40% |
| 6 | fragrance | 2%-6% |
| 7 | Stepantex VT 90 | 0.7%-1.5% |
| 8 | PHMB (polyhexamethylene biguanide) | 0.1%-0.4% |
| 9 | stearic acid | 0.5%-1.4% |
| 10 | silicon dioxide | 3%-4.5% |
| 11 | enzyme mix | .01%-0.1% |
| 12 | Kollidon CL | 3.5%-5.5% |
| 13 | Magnesium Stearate | 1%-2% |
| 14 | Long Brite | 0.05%-2% |

In another exemplary embodiment, Table 2 below depicts the components of the BABY formula.

| Item | Description | Percentage in each tablet |
|---|---|---|
| 1 | calcium carbonate | 0.5%-3% |
| 2 | sodium | 5%-20% |
| 3 | citric acid | 5%-20% |
| 4 | tartaric acid | 15%-30% |
| 5 | sodium bicarbonate | 30%-45% |
| 6 | fragrance | 1%-5% |
| 7 | Stepantex VT 90 | 0.3%-2.5% |
| 8 | polyhexamethylene biguanide | 0.01%-1% |
| 9 | stearic acid | 0.2%-2% |
| 10 | silicon dioxide | 0.5%-5% |
| 11 | enzyme mix | .0001%-0.5%% |
| 12 | Kollidon CL | 1%-10% |
| 13 | Magnesium Stearate | 0.5%-3% |
| 14 | Long Brite | 0.05%-2% |

In another exemplary embodiment, Table 3 below depicts the components of the DELICATE formula.

| Item | Description | Percentage in each tablet |
|---|---|---|
| 1 | calcium carbonate | 0.5%-3% |
| 2 | sodium | 5%-20% |
| 3 | citric acid | 5%-20% |
| 4 | tartaric acid | 15%-30% |
| 5 | sodium bicarbonate | 30%-45% |
| 6 | fragrance | 1%-5% |
| 7 | Stepantex VT 90 | 0.3%-2.5% |
| 8 | polyhexamethylene biguanide | 0.01%-1% |
| 9 | stearic acid | 0.2%-2% |
| 10 | silicon dioxide | 0.5%-5% |
| 11 | enzyme mix | .0001%-0.5%% |
| 12 | Kollidon CL | 1%-10% |
| 13 | Magnesium Stearate | 0.5%-3% |
| 14 | Long Brite | 0.05%-2% |

In another exemplary embodiment, Table 4 below depicts the components of the ARMY formula.

| Item | Description | Percentage in each tablet |
|---|---|---|
| 1 | calcium carbonate | 0.5%-3% |
| 2 | sodium | 5%-20% |
| 3 | citric acid | 5%-20% |
| 4 | tartaric acid | 15%-30% |
| 5 | sodium bicarbonate | 30%-45% |

-continued

| Item | Description | Percentage in each tablet |
|---|---|---|
| 6 | fragrance | 1%-5% |
| 7 | Stepantex VT 90 | 0.3%-2.5% |
| 8 | polyhexamethylene biguanide | 0.01%-1% |
| 9 | stearic acid | 0.2%-2% |
| 10 | silicon dioxide | 0.5%-5% |
| 11 | enzyme mix | .0001%-0.1%% |
| 12 | Kollidon CL | 1%-10% |
| 13 | Magnesium Stearate | 0.5%-3% |
| 14 | Sodium Disilicate/Sodium Carbonate | 1%-3% |
| 15 | Long Brite | 0.05%-2% |

In another exemplary embodiment, Table 5 below depicts the components of the SPORT formula.

| Item | Description | Percentage in each tablet |
|---|---|---|
| 1 | calcium carbonate | 0.5%-3% |
| 2 | sodium | 5%-20% |
| 3 | citric acid | 5%-20% |
| 4 | tartaric acid | 15%-30% |
| 5 | sodium bicarbonate | 30%-45% |
| 6 | fragrance | 1%-5% |
| 7 | Stepantex VT 90 | 0.3%-2.5% |
| 8 | polyhexamethylene biguanide | 0.01%-1% |
| 9 | stearic acid | 0.2%-2% |
| 10 | silicon dioxide | 0.5%-5% |
| 11 | enzyme mix | .0001%-0.1%% |
| 12 | Kollidon CL | 1%-10% |
| 13 | Magnesium Stearate | 0.5%-3% |
| 14 | Sodium Disilicate/Sodium Carbonate | 1%-3% |
| 15 | Long Brite | 0.05%-2% |
| 16 | Chlorohexidine Hydrochloride | 0.5%-2.5% |

In another exemplary embodiment, Table 6 below depicts the components of the TENNIS formula.

| Item | Description | Percentage in each tablet |
|---|---|---|
| 1 | calcium carbonate | 0.5%-3% |
| 2 | sodium | 5%-20% |
| 3 | citric acid | 5%-20% |
| 4 | tartaric acid | 15%-30% |
| 5 | sodium bicarbonate | 30%-45% |
| 6 | fragrance | 1%-5% |
| 7 | Stepantex VT 90 | 0.3%-2.5% |
| 8 | polyhexamethylene biguanide | 0.01%-1% |
| 9 | stearic acid | 0.2%-2% |
| 10 | silicon dioxide | 0.5%-5% |
| 11 | enzyme mix | .0001%-0.1%% |
| 12 | Kollidon CL | 1%-10% |
| 13 | Magnesium Stearate | 0.5%-3% |
| 14 | Sodium Disilicate/Sodium Carbonate | 1%-3% |
| 15 | Long Brite | 0.05%-2% |

Although exemplary embodiments of the present invention have been shown and described, it will be apparent to those having ordinary skill in the art that a number of changes, modifications or alterations to the invention described herein may be made, none of which depart from the spirit of the present invention. All such changes, modifications, and alterations should therefore be seen as being within the scope of the present invention.

It should be appreciated that the present invention provides a substantial advance in the manufacture and storage of effervescent type formulations, providing all of the herein-described advantages without incurring any relative disadvantages.

The terms "comprise", "comprises" and "comprising", as used herein, are used in the inclusive sense of "having", or "including", and not in the exclusive sense of "consisting only of".

What is claimed is:

1. An effervescent detergent tablet, comprising:

a) from 1% to 2% of calcium carbonate;
b) from 10% to 1.5% of sodium laureth sulfate;
c) from 10% to 15% of citric acid;
d) from 15% to 25% of tartaric acid;
e) from 30% to 40% of sodium bicarbonate;
f) less than 0.1% of enzyme mix;
g) from 1.5% to 4% of fragrance;
h) from 0.7% to 1.5% of Methyl bis[ethyl (tallowate)]-2-hydroxyethyl ammonium methyl sulfate;
i) from 0.1% to 0.4% of polyhexamethylene biguanide;
j) from 0.5% to 1.4% of stearic acid;
k) from 3% to 4.5% of silicon dioxide;
l) from 0.1% to 0.4% of Disodium Distyrylbiphenyl Disulfonate;
m) from 1% to 3% of Magnesium Stearate;
n) from 3% to 5% of Polyvinylpyrrolidone, crosslinked;
o) from 0% to 1.8% of Chlorhexidine Hydrochloride; and
p) from 0% to 1.8% of calcium carbonate and sodium disilicate mix.

2. A method of producing effervescent detergent tablets, said method comprising the steps of:

a) sifting silicon dioxide through a 1 mm sieve and mixing the sifted silicon dioxide to homogenize a first mixture;
b) adding an enzyme mix to the first mixture, and mixing the first mixture to homogenize the first mixture;
c) adding fragrances to the first mixture, and mixing the first mixture to homogenize the first mixture;
d) adding Methyl bis[ethyl (tallowate)]-2-hydroxyethyl ammonium methyl sulfate to the first mixture, and mixing the first mixture to homogenize the first mixture;
e) sifting calcium carbonate, sodium bicarbonate, citric acid, tartaric acid, sodium lauryl sulfate and Disodium Distyrylbiphenyl Disulfonate each through a 1 mm sieve to form a second mixture;
f) combining the first and second mixture to form a combined mixture, and mixing the combined mixture to form a homogenized combined mixture;
g) adding Polyvinylpyrrolidone, crosslinked to the combined mixture and mixing the combined mixture to form a homogenized combined mixture;
h) adding magnesium stearate and stearic acid to the combined mixture; and
i) forming the combined mixture into tablets.

3. A method according to claim 2, wherein each of the steps of mixing comprises mixing for at least ten minutes.

* * * * *